United States Patent [19]

Monden

[11] 4,262,823

[45] Apr. 21, 1981

[54] ATOMIZING PUMP

[75] Inventor: Yoshio Monden, Tokyo, Japan

[73] Assignee: Mitani Valve Co., Ltd., Tokyo, Japan

[21] Appl. No.: 910,123

[22] Filed: May 26, 1978

[30] Foreign Application Priority Data

Jun. 2, 1977 [JP] Japan ..... 52-71901[U]

[51] Int. Cl.[3] ..... B05B 9/043

[52] U.S. Cl. ..... 222/321; 222/383; 417/566

[58] Field of Search ..... 222/321, 380, 383, 385; 239/331, 333; 417/559, 560, 566

[56] References Cited

U.S. PATENT DOCUMENTS

| | | | |
|---|---|---|---|
| 3,527,551 | 9/1970 | Kutik et al. | 417/566 X |
| 4,025,046 | 5/1977 | Boris | 239/333 |
| 4,051,983 | 10/1977 | Anderson | 239/323 X |
| 4,089,442 | 5/1978 | Hafele | 222/385 X |
| 4,140,249 | 2/1979 | Majima | 222/321 |

*Primary Examiner*—Robert J. Spar
*Assistant Examiner*—Frederick R. Handren
*Attorney, Agent, or Firm*—Kenneth J. Stempler

[57] ABSTRACT

The disclosure relates to a so-called pressure accumulation type atomizing pump provided with no gravity-actuated check valve and having an upper hollow piston and a lower pistion adapted to be simultaneously moved downward along the inner surface of a valve cylinder, upon a depression of an atomizing push button, the upper and lower piston being adapted to pressurize the liquid accommodated by a housing chamber defined within the valve cylinder between the pistons. The increased pressure of the liquid acts to depress the lower piston to open a check valve leading to a nozzle, so that the pressurized liquid is atomized finely from the nozzle. The lower piston is so arranged as to effectively cooperate with the upper piston in sucking the liquid up during the sucking stroke of the pump and to additionally increase the sucking capacity of the pump.

1 Claim, 2 Drawing Figures

ATOMIZING PUMP

BACKGROUND OF THE INVENTION

The present invention relates to an atomizing pump of the pressure accumulation type.

Pressure accumulation type atomizing pump have advantages of atomization of extremely fine particles and highly uniform atomization which are afforded by a high liquid pressure accumulated therein.

A typical conventional atomizing pump making use of the accumulated liquid pressure is provided with a check valve such as a ball type check valve adapted to be operated by the force of gravity. However, this check valve relying upon the force of gravity causes inconvenience in handling, because it cannot function when the atomizing pump is used upside down, and makes the construction of the pump complicated to inconveniently render the size of the pump large. Thus, the conventional atomizing pump having a check valve relying upon the force of gravity is not suitable for use in combination with a small-sized liquid container such as for cosmetics.

It is true that various atomizing pumps having a check valve making no use of the gravity force have been proposed and used. However, all of these conventional atomizing pumps have suffered from the following disadvantage.

Namely, these conventional atomizing pumps have a liquid passage adapted to function as a liquid passage for sucking up the liquid. The check valve is provided at the communication region between the liquid passage and a housing chamber for pressurizing the liquid. Thus, the check valve is often moved to interrupt the communication in the sucking stroke, due to the force of gravity or other resetting force, before the sucking stroke is completed, i.e. while a space is still available in the housing chamber for accommodating a further volume of the liquid, failing to make full use of the volume of the housing chamber. This disadvantage is serious especially in case of small-sized liquid containers having small capacity of storage of liquid.

SUMMARY OF THE INVENTION

It is therefore a principal object of the invention to provide an improved atomizing pump which can overcome above described problems or shortcomings of the conventional atomizing pumps.

To this end, according to the invention, there is provided an improved construction of liquid atomizing pump of pressure accumulation type having the following structural features.

Namely, the pressure accumulation type atomizing pump in accordance with the invention has a valve cylinder having portions of increased diameter and reduced diameter which slidably receive, respectively, a large piston and a small piston. These pistons are adapted to cooperate with each other in defining a closed housing chamber within the valve cylinder for pressurizing the liquid. The housing chamber is adapted for communication with a liquid sucking pipe through an internal liquid passage formed in a tubular member. A check valve is provided in the internal liquid passage. At the same time, the housing chamber is adapted for communication with the atomizing nozzle through a check valve provided on the tubular member which is adapted to cooperate with a valve seat formed on the large piston. The small piston is formed at the lower end of the tubular member unitarily with the latter, so as to receive the liquid pressure in the housing chamber thereby to open the check valve leading to the nozzle. The reduced diameter portion of the valve cylinder is provided with a sliding inner peripheral surface the upper opening end of which is tapered outward. The top dead point of the stroke of the small piston is positioned within the area of this outwardly tapered portion of the reduced diameter portion of the valve cylinder. Thus, when the small piston has brought up to its top dead point, a space or gap is formed around the small piston for communication with the housing chamber. This gap is independent from the internal liquid passage formed in the tubular member and is adapted to be closed at an early stage of depressing stroke of the pump. During the sucking stroke of the pump, the liquid is sucked up into the housing chamber even after the internal liquid passage in the tubular member is closed, so that the sucking capacity of the pump is much increased over that of the conventional atomizing pump.

The above and other objects, as well as advantageous features of the invention will become clear from the following description of the invention taken in conjunction with the accompanying drawings.

DESCRIPTION OF THE PREFERRED EMBODIMENTS

Figure 1:
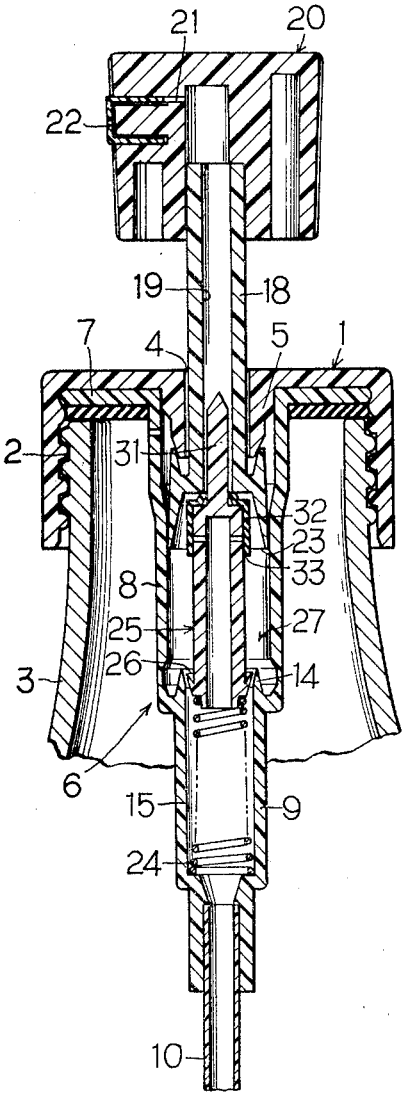
FIG. 1 is a longitudinal sectional view of a liquid atomizing pump embodying the invention when not used.
Figure 2:
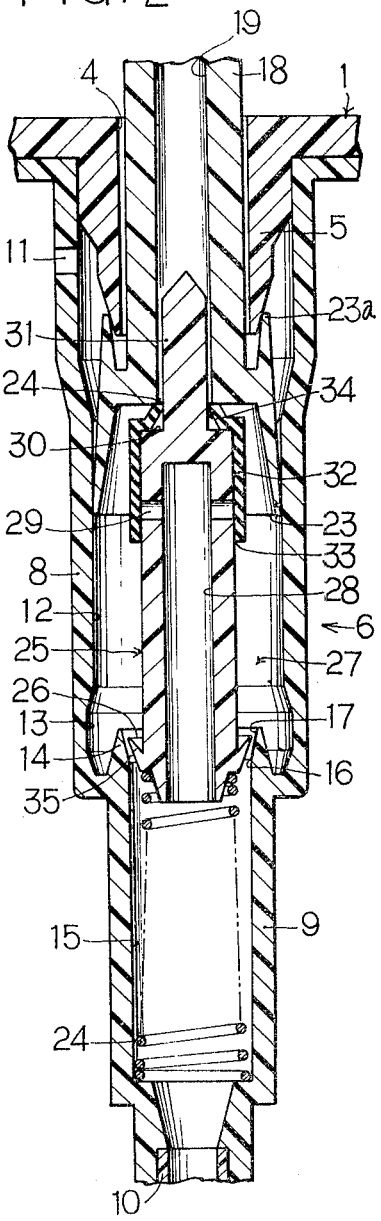
FIG. 2 is a partial enlarged longitudinal sectional view of the atomizing pump when not used.

The present invention is concerned with a liquid atomizing pump of pressure accumulation type which does not incorporate a check valve operated by the force of gravity, capable of sucking up an increased amount of liquid into the housing chamber for pressurizing the liquid over the conventional pressure accumulation type liquid atomizing pump.

Hereinafter, a preferred embodiment of the invention will be described in detail in conjunction with the accompanying drawings.

Referring to the drawings, reference numeral 1 denotes a cap screwed at the inner peripheral portion as at 2, so as to be screwed to a neck portion of a liquid container 3. The cap 1 is provided at the center of its upper wall with a central bore 4 from the lower edge of which extended is a short cylindrical hub 5 toward the back side of the cap 1. A valve cylinder 6 has an upper opening end closely fitted around the outer periphery of the cylindrical hub 5 while a flange 7 rigid with the valve cylinder 6 is fitted to the back side of the cap 1. Thus, the valve cylinder 6 is suspended from the cap 1 downward into the liquid container.

The valve cylinder 6 has an upper increased diameter portion 8 and a lower reduced diameter portion 9 which continuously merge in an intermediate shoulder section. A sucking pipe 10 is connected to the lower end of the reduced diameter portion 9. A vent port 11 is formed in the upper peripheral portion of the increased diameter portion 8 of the valve cylinder 6, for communication of the inside of the liquid container with the exterior. The increased diameter portion 8 has a sliding inner peripheral surface 12 along which a large piston is adapted to slide. An annular recess 13 of a slightly larger diameter than the sliding surface 12 is formed at the lower end of the latter.

The reduced diameter portion 9 is provided at its upper end with an extension 14 extended into the increased diameter portion 8. The reduced diameter portion 9 further has a piston sliding surface 15 which is continuous from the inner peripheral surface of the extension 14. The upper opening end of the sliding surface 15 is tapered outwardly to form a tapered opening 17 which starts from a top dead point 16 of the piston stroke.

The sliding surface 15 of the reduced diameter portion has a length smaller than that 12 of the increased diameter portion 8.

A depression valve tube 18 has an axial bore 19 formed therein and adapted to constitute a passage for liquid raised from the container 3. The upper portion of the depression valve tube 18 loosely passes through the central bore 4 of the cap 1 to project outwardly from the latter. An atomizing head or push button 20 is tightly fitted to the upper end of the depression valve tube 18. The arrangement is such that the aforementioned axial bore 19 is in communication with an internal passage formed in the push button 20 and further with a nozzle port 22.

At the lower end of the depression valve tube 18, formed unitarily with the latter is a large piston 23 adapted to slide along the sliding surface 12 of the increased diameter portion of the valve cylinder. The large piston 23 is urged upward resiliently by a coiled spring 24, which will be detailed later, to abut at its upper end 23*a* the outer periphery of the lower end of the cylindrical hub 5, thereby to interrupt the communication of the space in the valve cylinder with the exterior.

The axial bore 19 of the depression valve tube 18 opens in the increased diameter portion 8. A valve seat 24 is formed at the opening end of the axial bore 19.

A tubular member 25 has at its lower end portion a small piston 26 formed unitarily therewith. The small piston 26 is adapted to slide along the sliding surface 15 of the reduced diameter portion 9. The tubular member 25 is held upright within the valve cylinder 6, being supported by the aforementioned coiled spring 24 resting on the bottom of the reduced diameter portion 9. The large and small pistons 23 and 26 cooperate with each other in defining a housing chamber 27 for pressurizing the liquid, within the large diameter portion 8.

A blind bore 28 opening toward the reduced diameter portion 9 is formed in the tubular member 25. The upper end of the blind bore 28 is connected to lateral bores 29 formed to open in the peripheral wall of the tubular member 25, so as to form a liquid passage along which the liquid is sucked up from the sucking pipe. The space in the reduced diameter portion 9 is made to communicate with the housing chamber 27 through this liquid passage.

A needle section 31 is formed on the top end of the tubular member 25, through a shoulder region 30, and is loosely received by the axial bore 19 of the depression valve tube 18.

An elastic cap 32 is fitted around the upper portion of the tubular member 18, so as to cover the shoulder section 30 and the lateral bore 29. A check valve 33 adapted to be closed in delivery direction during the pumping operation is provided at the portion around the lateral bore 29. At the same time, another check valve 24*a* is provided for cooperation with the valve seat 24 in such a manner as to open in the delivery direction during the pumping operation.

The small piston 26 of the tubular member 25 has the same stroke as the upper large piston 23 and is adapted to perform an effective pumping action in cooperation with the latter. At the same time, the stroke of the smaller piston is larger than the axial length of the sliding surface 15 of the reduced diameter portion 9, so that the smaller piston is positioned at a level higher than the upper dead point 16 of the sliding. More specifically, the small piston 26 is positioned within the region of the tapered opening 17, beyond the upper dead point 16 of the slide, when it is brought to the top dead point of its stroke, so that a small annular gap 35 is formed around the small piston, thereby to allow the space in the reduced diameter portion 9 to communicate with the housing chamber 27.

This annular gap is so small as to be closed by the small piston 26 immediately after the commencement of the downward stroking of the pumping action.

In operation of the atomizing pump having the described construction, the check valve 33 is opened as the large and the small pistons 23,26 are moved from bottom dead point to the upper point of stroke, so as to allow the liquid to be sucked up into the housing chamber 27. As the small piston 26 has been brought to its top dead point of the stroke beyond the dead point 16 the annular gap 35 is formed to bring the space in the reduced diameter portion 9 into communication with the housing chamber 27, so that the liquid may additionally be sucked up into the housing chamber 27 through the annular gap 35 by the pumping action performed by the larger piston 23.

Usually, check valves are operated by the pressure differential applied across them. In those check valves adapted to be operated under the rule of force of gravity, or having their own resetting force, the safe closing operation often fails as the pressure differential becomes small. However, according to the invention, the sucking operation is continued by the large piston, thanks to the provision of the annular gap 35, even in the final period of the sucking stroke at which the pressure differential has become small. Consequently, the sucking capacity of the housing chamber 27 is additionally increased as compared to that performed by conventional atomizing pumps having a check valve whose operation relies upon the force of the gravity.

Such an atomizing pump is known having an upper piston and a lower piston, wherein the latter is normally kept in contact with the associated sliding surface but its outer periphery is axially deflected upon receipt of a large pumping action of the large piston, so as to form a small annular gap around thereof, thereby to allow the additional sucking of the liquid. However, the atomizing pump in accordance with the invention is patentably distinguished from such a type of pump, because the latter can have only a limited sucking capacity due to the presence of the mechanism for resetting the small piston and a poor maneuverability attributable to the friction.

The annular gap 35 is closed by a short stroking of the small piston 26 from its top dead point of stroke, immediately after the commencement of pressurizing pumping stroke initiated by the depression of the atomizing button 20, so as to close the housing chamber 27, thereby to enable the latter to pressurize the liquid sucked up and accommodated therein. As the pressure of the liquid comes to overcome the resilient force exerted by the lower coiled spring 24, the small piston is lowered at a speed larger than that of the depression, so as to open the check valve 34, thereby to allow the pressurized liquid to be atomized finely through the nozzle.

As the downward pumping stroke has been completed, the large piston 23 partially leaves the sliding surface 12 with which it has been in close engagement, to come to be received by the annular recess 13. Consequently, room is formed around the large piston, through which the housing chamber 27 is allowed to communicate the exterior, so as to achieve an equilibrium between the inside and outside of the housing chamber to facilitate the subsequent liquid sucking up operation.

As has been described, according to the invention, the liquid sucking up capacity of the atomizing pump is additionally increased over that performed by conventional pumps. Thus, it becomes possible to advantageously and remarkably make the most of the limited volume of the housing chamber of a small-sized atomizing pump combined with a small-sized liquid container such as that for cosmetics.

What is claimed is:

1. An atomizing pump comprising:

a valve cylinder;

a variable volume fluid receiving chamber in said valve cylinder;

first and second slidable pistons defining opposite ends of said fluid chamber, said first piston being larger than the second piston, said valve cylinder being larger over a portion of its length to slidably accommodate said first piston, said second piston having a tube thereon extending toward said first piston;

fluid passage means in said first piston for communicating said fluid chamber with an atomizing passage;

fluid passage means in said second piston extending into said tube and communicating a source of fluid to be vaporized with said fluid chamber;

a plastic cap mounted on said tube and having a skirt and a tip, the tip comprising a first check valve means in said fluid chamber for controlling the flow of fluid from said chamber to the fluid passage means in said first piston, said skirt normally covering the fluid passage means in the second piston and movable from the covering position in response to fluid pressure to thereby comprise a second check valve means in said fluid chamber for controlling the flow of fluid from said source to said fluid chamber;

means for moving the first and second pistons in a direction to increase the pressure in said fluid chamber, said first check valve means allowing fluid to express therethrough in response to the increased pressure in said fluid chamber;

means for returning the first and second pistons to their original position and creating a reduced pressure in said fluid chamber, said second check valve means being responsive to said reduced pressure to allow fluid to flow from said source to said fluid chamber;

said second piston being within the smaller portion of the valve cylinder when the pressure in the fluid chamber is increased, the length of the walls of said smaller portion being sufficiently short so that the second piston exits from the smaller portion of the valve cylinder, creating a gap between the second piston and the smaller portion at a selected point in the return travel of said second piston thus permitting the reduced pressure in the fluid chamber to suck additional fluid from the source through the second check valve into said fluid chamber.

* * * * *